US009940775B2

(12) United States Patent
Eaton et al.

(10) Patent No.: US 9,940,775 B2
(45) Date of Patent: Apr. 10, 2018

(54) SYSTEM AND METHOD FOR A WAGERING GAME HAVING GUARANTEED WINS

(71) Applicant: WMS Gaming Inc., Waukegan, IL (US)

(72) Inventors: Leon Eaton, Richmond (GB); Andrew Guinn, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 290 days.

(21) Appl. No.: 14/731,728

(22) Filed: Jun. 5, 2015

(65) Prior Publication Data

US 2016/0358412 A1 Dec. 8, 2016

(51) Int. Cl.
*G07F 17/32* (2006.01)

(52) U.S. Cl.
CPC ..... *G07F 17/3213* (2013.01); *G07F 17/3223* (2013.01); *G07F 17/3267* (2013.01)

(58) Field of Classification Search
CPC ..... G07F 17/3213; G07F 17/3267; G07F 17/3223; G07F 17/326
See application file for complete search history.

(56) References Cited

U.S. PATENT DOCUMENTS

| | | | | |
|---|---|---|---|---|
| 5,083,785 | A | 1/1992 | Okada | 273/143 R |
| 5,429,361 | A | 7/1995 | Raven et al. | 273/138 A |
| 5,855,514 | A | 1/1999 | Kamille | 463/17 |
| 5,931,467 | A | 8/1999 | Kamille | 273/139 |
| 7,331,859 | B2 | 2/2008 | Hornik et al. | 463/16 |
| 7,364,506 | B2 | 4/2008 | Jaffe et al. | 463/20 |
| 7,775,872 | B2 | 8/2010 | Bleich et al. | 463/20 |
| 7,846,015 | B2 | 12/2010 | Bansemer et al. | 463/16 |
| 7,857,699 | B2 | 12/2010 | Baerlocher | 463/27 |
| 8,137,181 | B2 | 3/2012 | Bleich et al. | 463/20 |
| 8,182,344 | B2 | 5/2012 | Bleich et al. | 463/37 |
| 8,282,462 | B2 | 10/2012 | Fujimoto et al. | 463/20 |
| 8,292,722 | B2 | 10/2012 | Okada | 463/20 |
| 8,342,936 | B2 | 1/2013 | Okada | 463/20 |
| 8,371,926 | B2 | 2/2013 | Okada | 463/20 |
| 8,430,740 | B2 | 4/2013 | Yamauchi | 463/20 |
| 8,435,112 | B2 | 5/2013 | Fujimoto et al. | 463/27 |
| 8,449,381 | B2 | 5/2013 | Fujimoto et al. | 463/25 |
| 8,500,549 | B2 | 8/2013 | Fujimoto et al. | 463/25 |
| 8,622,811 | B1 | 1/2014 | Aoki et al. | 463/20 |
| 8,747,207 | B2 | 6/2014 | Thomas et al. | 463/16 |
| 2004/0023710 | A1 | 2/2004 | McGahn et al. | 463/16 |

(Continued)

*Primary Examiner* — Jasson Yoo
(74) *Attorney, Agent, or Firm* — David J. Bremer

(57) ABSTRACT

A gaming system includes game-logic circuitry performing at least one regulated casino wagering game including a base game and a bonus game. The player accrues at least one of a number of free spins and a number of guaranteed wins for the bonus game. The free spins allow a player to win awards without further wagering. The guaranteed wins may trigger a re-spin of one or more free spins of the bonus game, result in a monetary award directly based upon symbols of a cash reel, or specify a minimum guaranteed wins threshold for a given base game or bonus game spin. The guaranteed wins may decrement with free spins when the free spin awards are above zero. Each guaranteed win remaining after all the free spins are completed may result in a cash reel displaying a symbol corresponding to a specific award.

20 Claims, 10 Drawing Sheets

(56) References Cited

U.S. PATENT DOCUMENTS

| | | | | |
|---|---|---|---|---|
| 2004/0147306 | A1* | 7/2004 | Randall | G07F 17/32 463/20 |
| 2004/0152507 | A1 | 8/2004 | Baerlocher et al. | 463/16 |
| 2004/0229700 | A1 | 11/2004 | Cannon et al. | 463/42 |
| 2005/0037836 | A1* | 2/2005 | Gilmore | G07F 17/3244 463/25 |
| 2005/0101375 | A1 | 5/2005 | Webb et al. | 463/25 |
| 2007/0243934 | A1* | 10/2007 | Little | G07F 17/32 463/40 |
| 2008/0102920 | A1 | 5/2008 | Baerlocher | 463/20 |
| 2008/0182657 | A1 | 7/2008 | Bennett et al. | 463/27 |
| 2009/0121425 | A1 | 5/2009 | Berkowitz | 273/139 |
| 2009/0247277 | A1 | 10/2009 | Caspers et al. | 463/20 |
| 2010/0016065 | A1 | 1/2010 | Nicely et al. | 463/25 |
| 2010/0069160 | A1 | 3/2010 | Barrett | 463/46 |
| 2010/0210336 | A1* | 8/2010 | Berman | G07F 17/3267 463/16 |
| 2010/0234099 | A1 | 9/2010 | Rasmussen | 463/29 |
| 2011/0053676 | A1 | 3/2011 | Wolf et al. | 463/20 |
| 2011/0223983 | A1 | 9/2011 | Schwartz et al. | 463/17 |

* cited by examiner

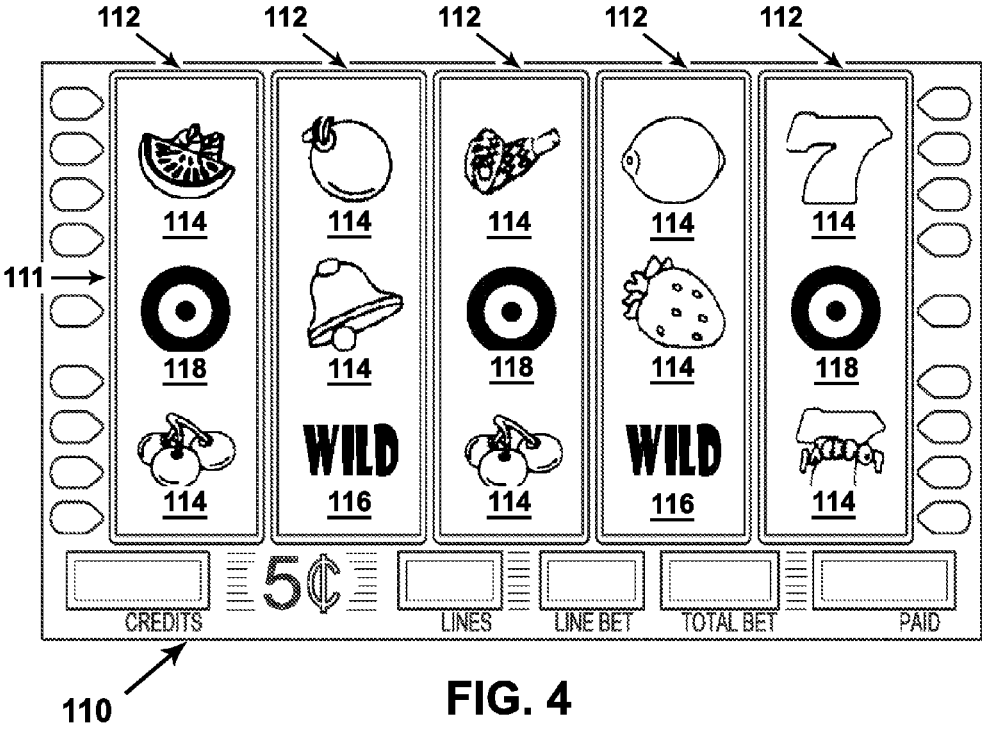
FIG. 4
FIG. 5
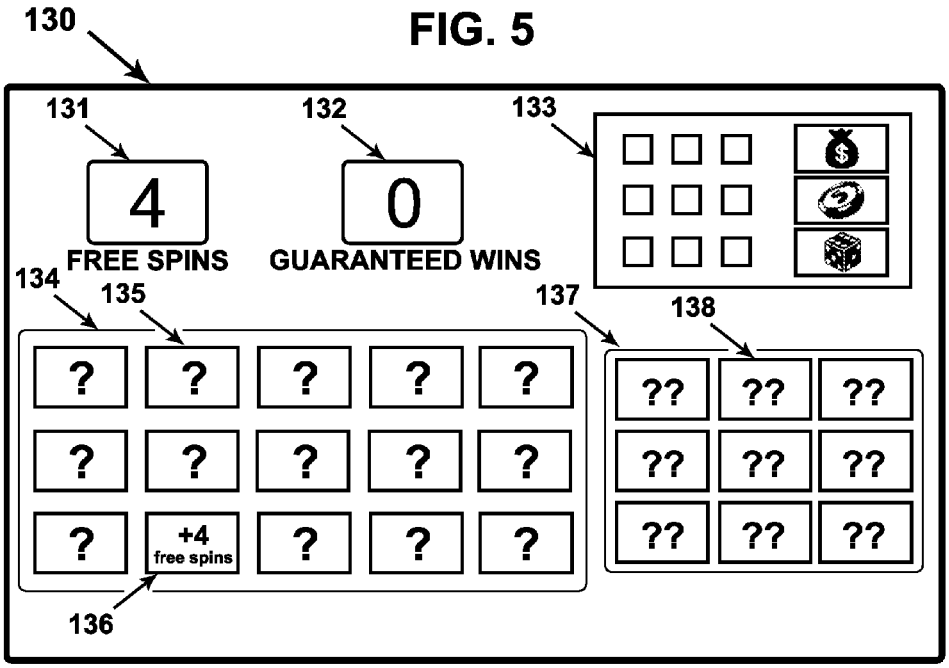

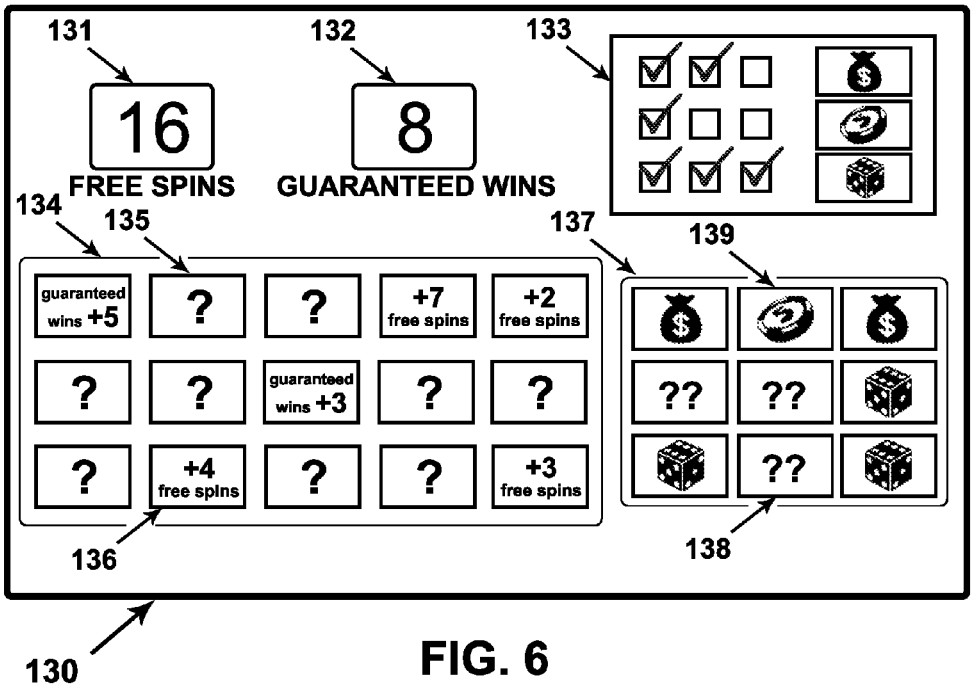
FIG. 6
FIG. 7
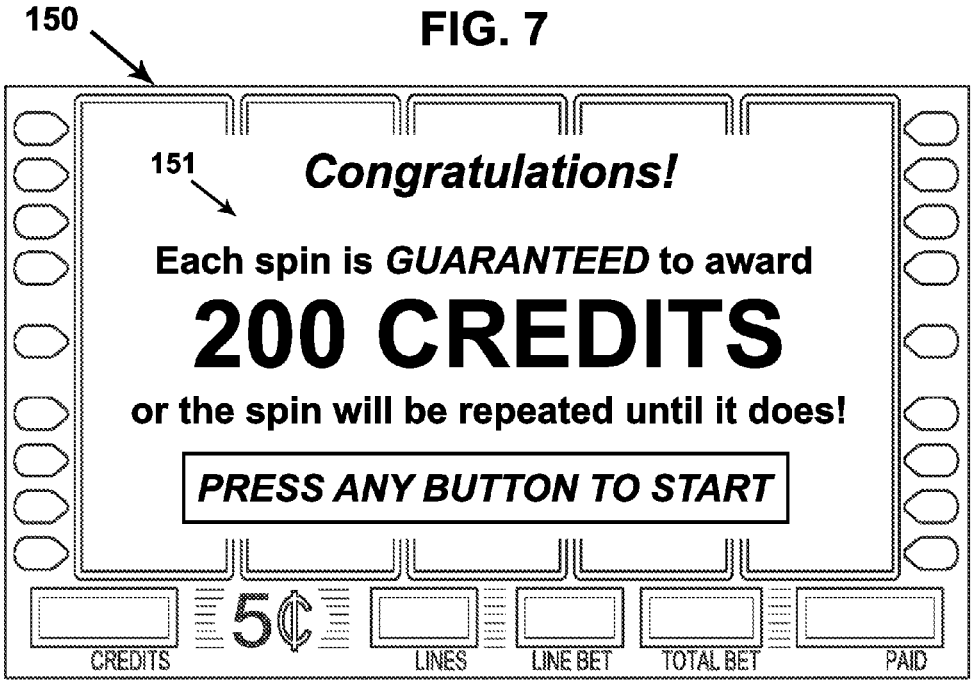

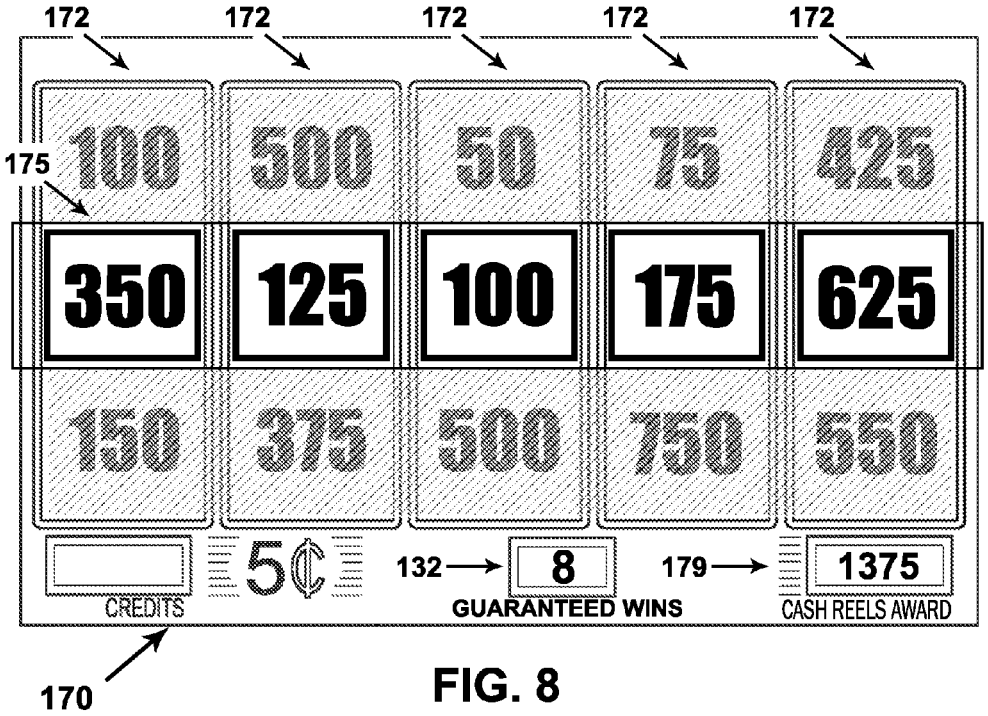
FIG. 8
FIG. 9
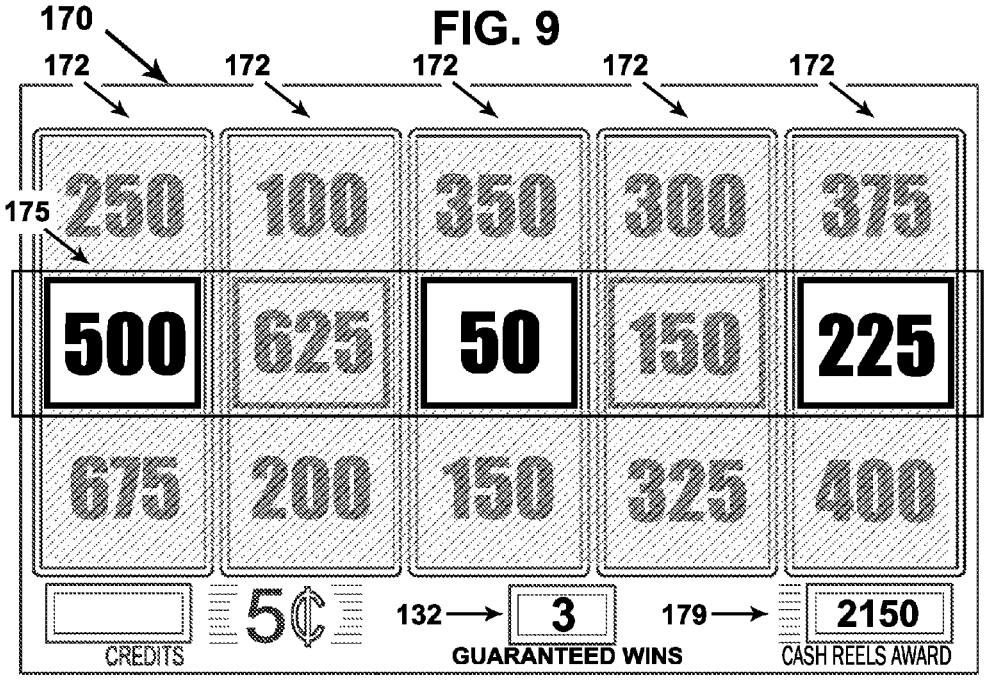

SYSTEM AND METHOD FOR A WAGERING GAME HAVING GUARANTEED WINS

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to a method and gaming system having a bonus feature that includes a guaranteed win provision for one or more wagering game plays.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a gaming system comprises an electronic display device, an electronic input device, a random element generator, and game-logic circuitry. The gaming system is primarily dedicated to playing at least one regulated casino wagering game having a base game and a bonus game. The gaming system may be incorporated into a single, freestanding gaming machine. The electronic input device is configured to receive a physical input from a player associated with a wager and transform the input into an electronic data signal. The random element generator is configured to generate one or more random elements. The game-logic circuitry is configured to determine an outcome of the base game based, at least in part, on the one or more random elements, and grant an award in response to the outcome of the base game meeting a predetermined award criterion. In response to a triggering event, the game-logic circuitry conducts the bonus game by directing the electronic display device to display indicia. In response to receiving data signals from the electronic input device indicative of indicia selections, the game-logic circuitry awards at least one of a free spin, a guaranteed win, or both, until a predetermined condition is met, wherein a positive number of guaranteed wins are accrued. The game-logic circuitry directs the electronic display device to display a plurality of symbol-bearing reels for the bonus game. After the predetermined condition is met and while a number of the accrued free spins is greater than zero, the plurality of symbol-bearing reels are spun and stopped to display a symbol combination representing a free spin outcome based, at least in part, on the one or more random elements. The number of accrued guaranteed wins is decremented in response to the displayed symbol combination being a non-losing outcome corresponding to a minimum award threshold. An award is granted corresponding to the displayed non-losing outcome and the number of the accrued free spins is decremented. The process of generating free spin outcomes using the accrued free spins is repeatedly performed until the number of accrued free spins equals zero. If any accrued guaranteed wins are remaining after completing all the accrued free spins, at least one cash-spin reel is displayed. The at least one cash-spin reel is populated with one or more cash symbols specifying a monetary award amount. The at least one cash-spin reel is spun and stopped to display a cash symbol, based, at least in part, on the one or more random elements, for each of the remaining accrued guaranteed wins. In response to stopping the at least one cash-spin reel, the number of accrued guaranteed wins is decremented and an award is granted corresponding to at least one of the displayed cash symbols.

According to one aspect of the present invention, a gaming system comprises an electronic display device, an electronic input device, a random element generator, and game-logic circuitry. The gaming system is primarily dedicated to playing at least one regulated casino wagering game having a base game and a bonus game. The gaming system may be incorporated into a single, freestanding gaming machine. The electronic input device is configured to receive a physical input from a player of a wager and transform the input into an electronic data signal, and a random element generator is configured to generate one or more random elements. The game-logic circuitry is configured to determine an outcome of the base game based, at least in part, on the one or more random elements and grant an award in response to the outcome of the base game meeting a predetermined award criterion. The game-logic circuitry is configured to, in response to a triggering event, provide the player a first number of free spins and a second number of guaranteed-win plays. For each of the first number of free spins, a first plurality of symbol-containing reels are rotated to a random stop position determined, at least in part, by the one or more random elements. Awards are paid associated with the random stop position and the number of guaranteed-win plays is decremented. At the conclusion of the first number of free spins, if at least one guaranteed-win play remains, an outcome for each guaranteed-win play is displayed to the player, providing a guaranteed award associated with each guaranteed-win play.

According to another aspect of the invention, a computer-implemented method in a gaming system primarily dedicated to playing at least one regulated casino wagering game having a base game and a bonus game is disclosed. The gaming system includes a random element generator, game-logic circuitry, and a casino gaming machine. The casino gaming machine includes a secure gaming cabinet, an electronic display device, and an electronic input device. The gaming cabinet is constructed to house components associated with the casino wagering game, and the electronic display device and the electronic input device are coupled to the gaming cabinet. The method of operating the gaming system includes receiving a wager input and initiating the casino wagering game in response to a physical input to the electronic input device of the casino gaming machine. One or more random elements are generated by the random element generator. The game-logic circuitry determines an outcome of the base game based, at least in part, on the one or more random elements and grants an award in response to the outcome of the base game meeting a predetermined award criterion. The game-logic circuitry provides the player a first number of free spins and a second number of guaranteed-win plays in response to a triggering event. The game-logic circuitry rotates a first plurality of symbol-containing reels to a random stop position for each of the first number of free spins. The random stop position(s) are determined, at least in part, by the one or more random elements. The game-logic circuitry pays any awards associated with the random stop position and decrements the number of guaranteed-win plays. At the conclusion of the first number of free spins, in response to at least one guaranteed-win play remaining, an outcome for each guaranteed-win play is displayed on the electronic display device to the player and a guaranteed award associated with each guaranteed-win play is provided.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 4 is an image of an exemplary screen of a base game of a wagering game displayed on a gaming machine, according to an embodiment of the present invention.

FIGS. 5-6 are images of an exemplary screen of a bonus game of a wagering game displayed on a gaming machine, according to an embodiment of the present invention.

FIG. 7 is an image of an exemplary screen of a wagering game displayed on a gaming machine notifying a player to participation in a guaranteed win feature, according to an embodiment of the present invention.

FIGS. 8-9 are images of an exemplary screen of a bonus game of a wagering game displayed on a gaming machine using guaranteed win cash reels, according to an embodiment of the present invention.

Figure 1:
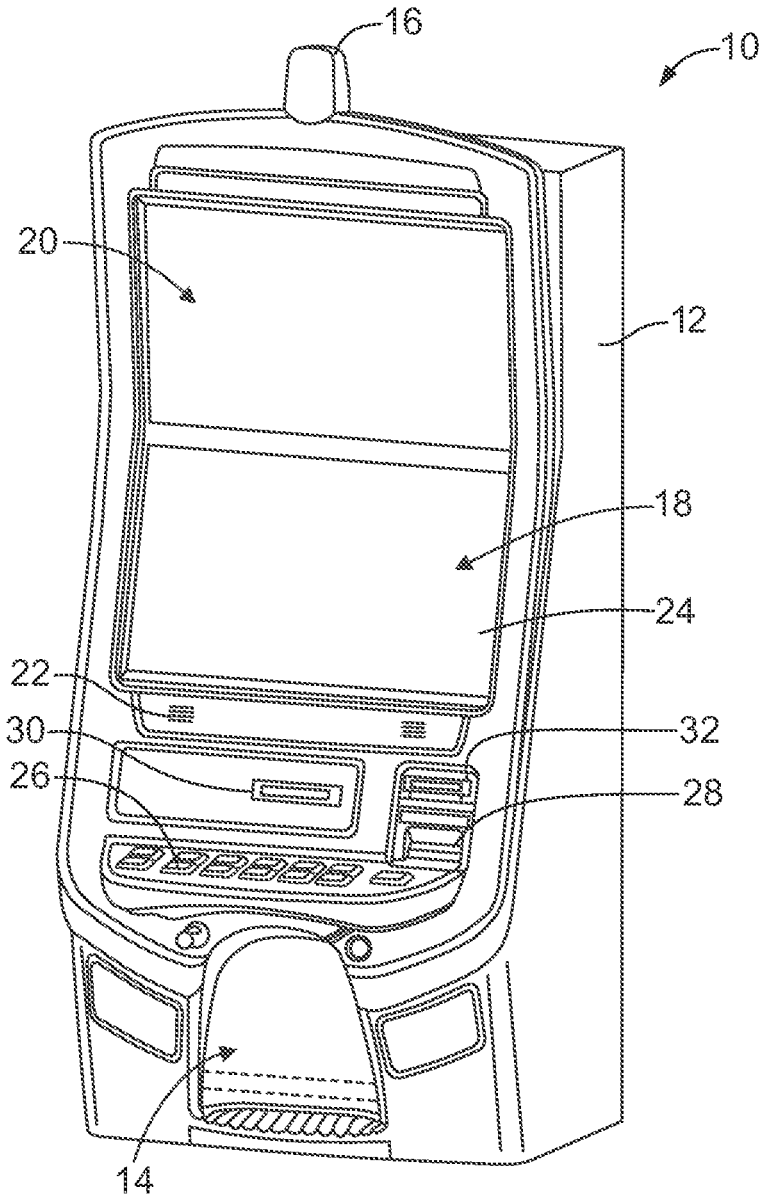
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bar top models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. No. 6,517,433, U.S. Pat. No. 8,057,303, and U.S. Pat. No. 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
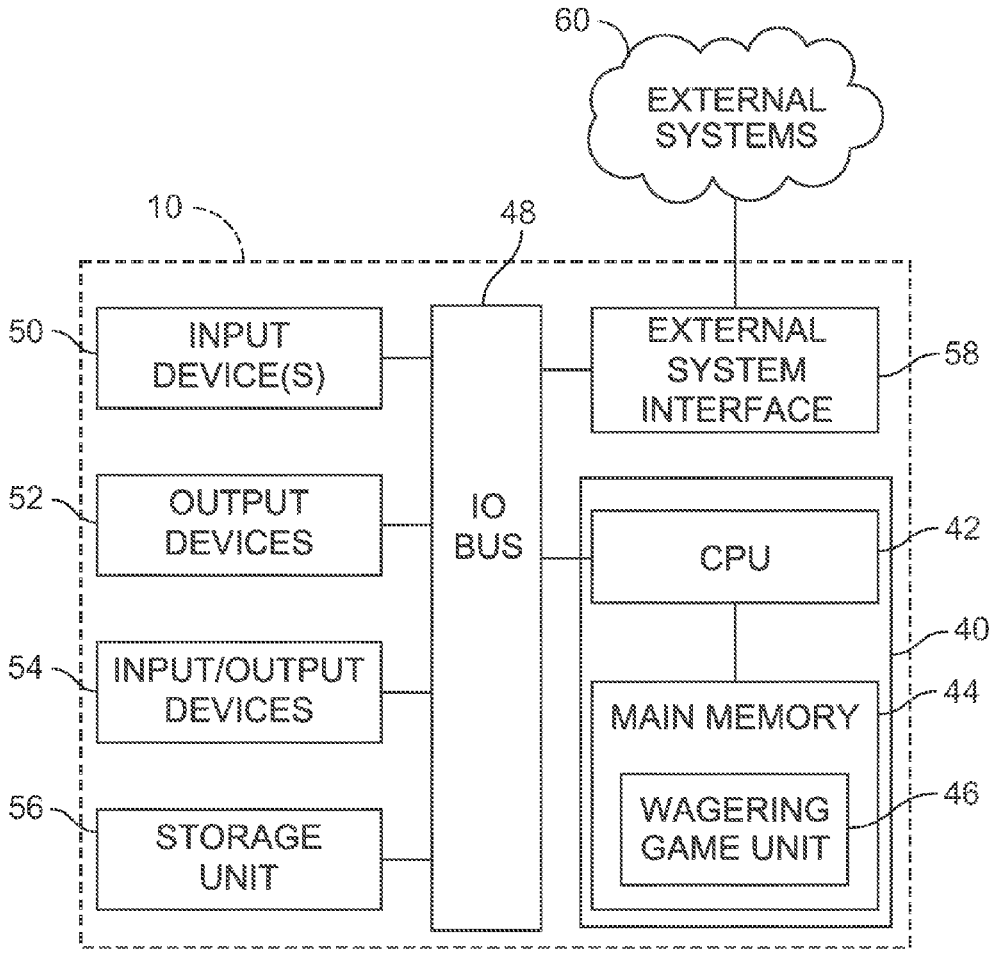
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compares it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
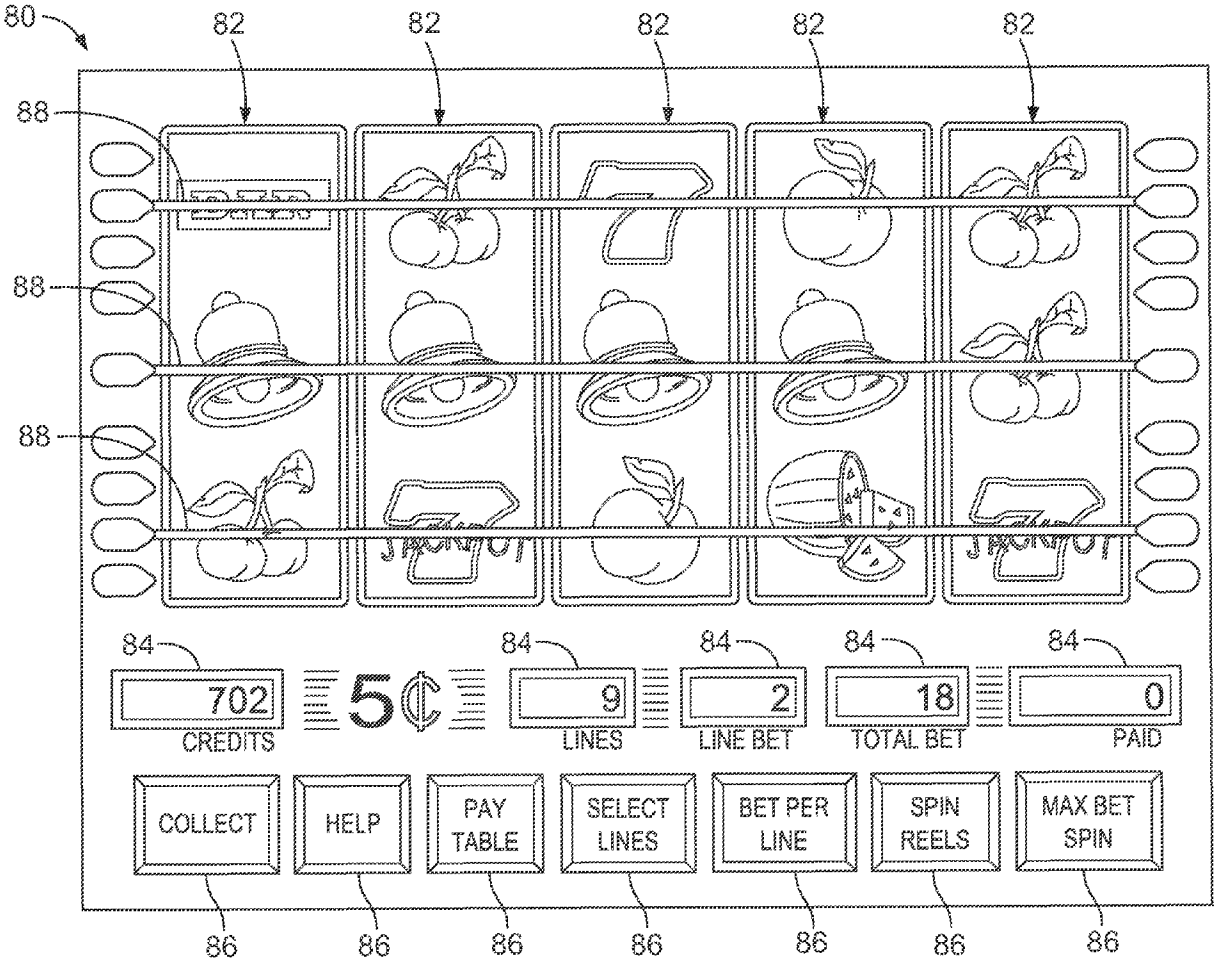
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Referring now to FIG. 4, an exemplary screen 110 of a wagering-game base game is shown according to one embodiment. The exemplary screen 110 may be displayed on one or more output display devices, for example, a primary display 18 or a secondary display 20 of a gaming machine 10. Display of the base game exemplary screen 110 may occur as a result of a player actuating one or more of the buttons 26 or the touch screen buttons 86 of the wagering game machine 10, causing an initiation of an instance of the wagering game to occur. For example, the wagering game may be initiated by a player upon confirmation of a wager amount and pressing a "BEGIN GAME" button.

The base game 110 of the wagering game includes five distinct reels 112 that rotate and stop at a given reel stop location, each reel 112 revealing symbols as part of a base-game outcome 111. The symbols of the base-game outcome 111 may include standard symbols 114, WILD symbols 116, and triggering symbols 118. Revealed symbols that are different than the symbols shown, as well different types of symbols may also be used to populate the corresponding reel strips of each reel 112. The number of symbols and configuration of symbols on each reel 112 is arbitrary and variable. Further, the probability of a particular symbol being revealed as part of the base-game outcome 111 may or may not be directly related to the number of that particular symbol on a given reel 112. Ultimately, the symbols that each reel 112 displays as part of the base-game outcome 111 is determined by one or more random elements as detailed prior.

In one embodiment, one or more specific patterns of triggering symbols 118 may trigger a bonus game to occur as part of the wagering game. The three triggering symbols 118 displayed in the base-game outcome 111 may indicate one type of bonus game to occur, and the revealing of additional triggering symbols 118 may indicate additional features of the bonus game, or even a completely different bonus game. For example, the three triggering symbols 118 displayed on the center pay line of the base-game outcome 111 may initiate a bonus round granting free spins and guaranteed win spins, and the presence of an additional triggering symbol 118 on the center pay line may additionally award the player a guaranteed win amount for each granted free spin during the bonus game. Any combination of bonus games and features for the bonus game are envisioned as within the spirit and scope of the invention.

In one embodiment, after the reels 112 stop spinning, the base-game outcome 111 is revealed having an array of graphical symbols. The base-game outcome 111 is analyzed to determine whether any displayed symbol combinations match one or more winning criteria (e.g., combinations of symbols) specified in the pay table for the wagering game. If so, an award total for each winning criteria is accumulated as part of a base-game award to be granted to the player upon conclusion of the wagering game instance (i.e., at the conclusion of the base game and any additional bonus games).

Referring now to FIGS. 5 and 6, an exemplary screen 130 of a bonus game of a wagering game is shown according to one embodiment. The bonus game exemplary screen 130 includes a free-spin meter 131, a guaranteed-win meter 132, an icon-tally zone 133, a primary-icon-selection zone 134, and a secondary-icon-selection zone 137.

The primary icon-selection zone 134 includes an array of hidden primary icons 135. Upon selection of a hidden primary icon 135, the hidden primary icon 135 is transformed into a revealed primary icon 136. In one embodiment, the revealed primary icons 136 grant either free spins or guaranteed wins to the player, incrementing the free-spin meter 131 or the guaranteed-win meter 132, respectively.

The secondary-icon-selection zone 137 includes an array of hidden secondary bonus icons 138. Upon selection of a hidden secondary bonus icon 138, the hidden secondary bonus icon 138 is transformed into a revealed secondary bonus icon 139. In one embodiment, the revealed secondary bonus icons 139 reflect icons that are revealed upon selection until a predetermined combination of the revealed secondary bonus icons 139 is displayed. The revealed secondary bonus icons 139 may determine the bonus level or specific type of bonus game, in addition to one or more bonus game features that are used in upcoming phase(s) of the bonus round of the wagering game.

Once one or more predetermined combinations of the revealed secondary bonus icons 139 are displayed, the revealed secondary bonus icons 139 shown may dictate special events to take place in the bonus round. For example, one combination of revealed secondary bonus icons 139 may result in one or more particular bonus games being played, simultaneously or sequentially. Another combination of revealed secondary bonus icons 139 may result in one or more special bonus game features occurring, for example, WILD symbols overlaying specific reels 112 of the symbol array, increased WILD symbols on one or more reels 112, an increased win award multiplier, etc. A given combination of revealed secondary bonus icons 139 may result in increased free spins and/or increased guaranteed wins by incrementing the free-spin meter 131 and/or the guaranteed-win meter 132, accordingly. Other combinations may provide the player with one or more predefined awards, a threshold for non-zero credit awards on all future spins of the bonus game or an upcoming wagering game, or an accrued minimum win amount for a set of one or more base or bonus game spins, for instance. The specific effect(s) of predetermined combinations or patterns in the icon-tally zone 133 are highly variable and open to modification without departing from the spirit and scope of the invention.

In one embodiment, at the start of the bonus game, the player is directed to select a hidden primary icon 135. Upon selection, the hidden primary icon 135 becomes a revealed primary icon 136 (revealing a corresponding number of free spins or guaranteed-win spins), and the player is directed to select a hidden secondary bonus icon 138. Upon selection, the hidden secondary bonus icon 138 becomes a revealed secondary bonus icon 139, and a determination is made as to whether a predetermined combination of the revealed secondary bonus icons 139 is displayed. If not, the player repeatedly selects another hidden primary icon 135 and another hidden secondary bonus icon 138 until a predetermined combination of the revealed secondary bonus icons 139 is displayed. During this process, the meters 131, 132 are incremented accordingly in response to each revealed primary icon 136, and corresponding tally marks are made in the tally zone 133 in response to each revealed secondary bonus icon 139.

In one embodiment, after a predetermined combination of bonus icons are selected in the secondary icon selection zone 137 (as indicated in the icon-tally zone 133), all the selected icons from both the primary-icon-selection zone 134 and the secondary-icon-selection zone 137 may be removed from view. The remaining unselected hidden primary and secondary icons 135, 138 may then be transformed into revealed icons 136, 139, allowing the player to see any icons that were not selected during the icon selection phase.

It should be noted that although the illustrated embodiment uses a specific player-selection mechanic to determine the number of free spins and guaranteed-win plays to award to the player, there are numerous possible award mechanics for providing the spins and plays. For example, in one embodiment, the spins and plays are collected over the course of base game play. The spins and plays may increment and decrement (or solely increment) during the base game until such time as a triggering event occurs and puts the spins and plays to their intended use in the bonus game. In other embodiments, the spins and plays may be randomly awarded or supplemented at the beginning of a bonus event, or determined based on the particular triggering event that initiated the bonus event.

Referring now to FIG. 7, an exemplary screen 150 of a wagering-game is shown according to one embodiment. In one embodiment, the exemplary screen 150 notifies a player of the wagering game that a guaranteed credit win for each spin of the reels is being granted. The notification 151 is displayed such that the player can readily identify any granted benefits. In one embodiment, the notification 151 shows that the player will be guaranteed to win a minimum of two-hundred credits for each conducted spin. Thus, if the reel(s) result in a spin outcome having a total award of less than two-hundred credits (e.g., 0 credits, 25 credits, 150 credits, etc.), the reel(s) will be performed again and another spin outcome generated until the minimum two-hundred credit award result is achieved, and the spin is correspondingly considered completed (e.g., deducted from a corresponding meter 131, 132).

Referring now to FIGS. 8-9, an exemplary screen 170 of a cash reel bonus game as part of a wagering game is shown according to one embodiment. The exemplary screen 170 includes the guaranteed-wins meter 132, a set of cash reels 172, and an award symbol group 175 for each of the cash reels 172. When the cash reel bonus game shown by exemplary screen 170 is conducted, a number of cash reels 172 are spun for each of the guaranteed wins specified in the meter 132, and a total cash reel award meter 179 is correspondingly incremented.

In one embodiment shown in FIG. 8, eight guaranteed wins are specified in the meter 132. All five cash reels 172 are spun and the corresponding credit awards displayed by the award symbols of the group 175 are accumulated (i.e., tallied) and reflected in meter 179. Due to the presence of only five cash reels 172, three guaranteed wins remain. After the initial guaranteed cash reel spins are completed, the three remaining guaranteed win cash spins are subsequently conducted as shown in FIG. 9. Three of the cash reels 172 are spun again and the corresponding credit awards displayed by the award symbols of the group 175 are accumulated in meter 179.

It is noted that a guaranteed win for each cash reel 172 may also be specified. For example, notification 151 may specify that a minimum award of two-hundred fifty credits be guaranteed for each of the cash reels 172 during each spin. Three of the five cash reels displayed in FIG. 8 would be eligible to be spun again in order to meet the higher guaranteed win award, potentially resulting in six guaranteed wins reflected in the meter 132 of FIG. 9, instead of the displayed three guaranteed wins. That is, each cash reel 172 would be spun (and re-spun) until a symbol corresponding to an award higher than the designated threshold is obtained, optionally while accruing awards during the trials.

Further, another type of guaranteed win may be granted that guarantees a minimum winning credit amount for the entirety of the wagering game, the entirety of the bonus game, or one or more spins of the wagering game and/or bonus game. In one embodiment, an exemplary screen 150 may be constructed and displayed specifically informing the player that a minimum credit amount is guaranteed for the bonus game as a whole (from beginning to end). The minimum credit win may also apply to a set of one or more consecutive spins considered together. For example, a minimum of two-hundred credits may be applied to a set of three free spins, wherein when the three free spins are conducted and completed and the accrued awards for the three spins are compared against the guaranteed win minimum amount. Additional free spins may be conducted until the accrued awards meet or exceed the specified minimum for the three free spins. In other embodiments, the accrued guaranteed win minimum may apply to the entirety of the bonus round, the entirety of the cash spins portion of the bonus round, or the wagering game as a whole including the one or more conducted portions of the bonus round(s), where an accrued award amount is maintained and actively compared against the guaranteed win minimum and additional game events occur until the guaranteed minimum amount is accrued. An additional meter 84 may also reflect a tracked accrual of credits when engaged in this type of guaranteed win award scenario.

Figure 10:
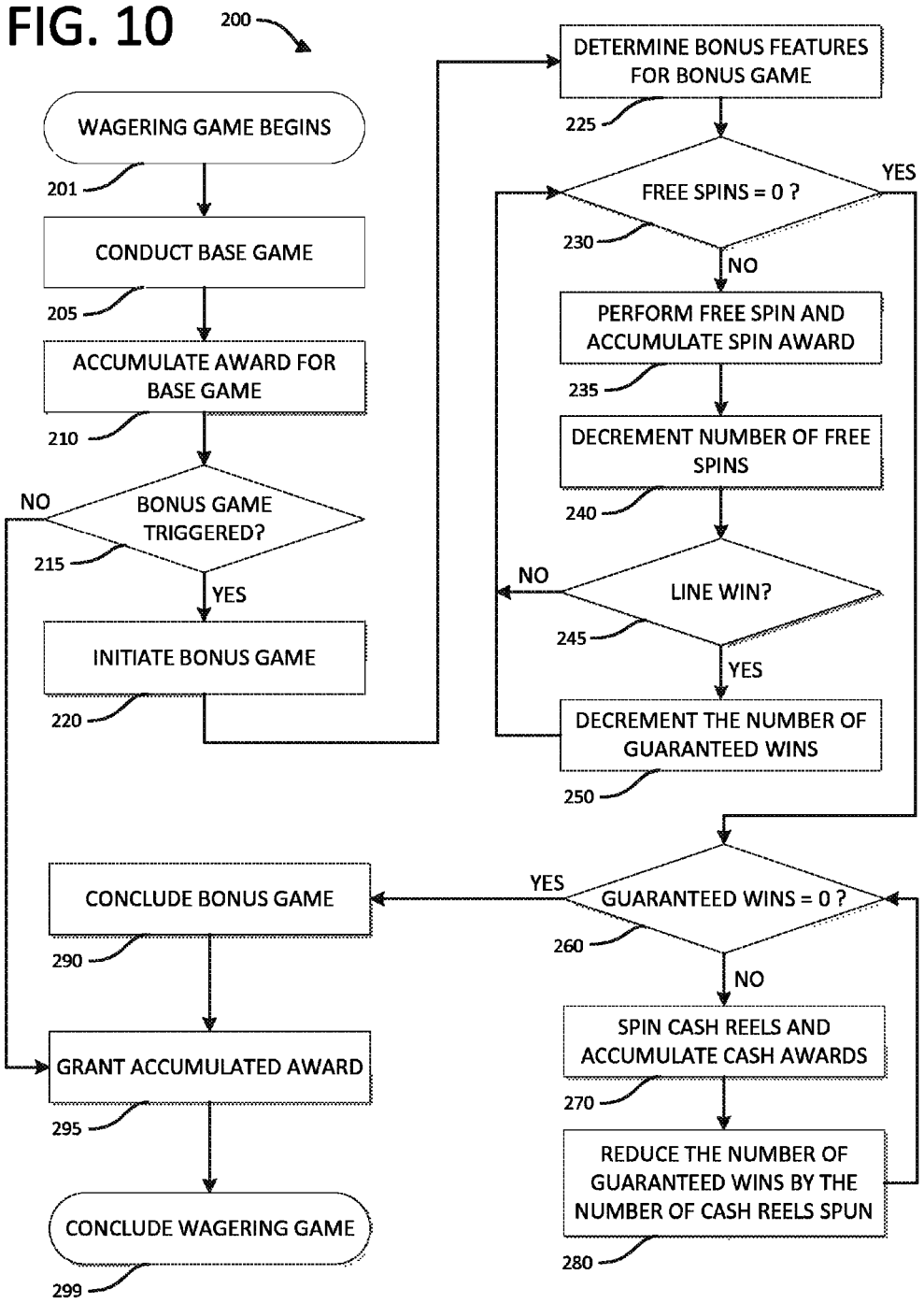
FIG. 10 is a flowchart for a generalized process, corresponding to instructions executed by a controller, for performing a wagering game using guaranteed wins that includes the screens of FIGS. 4-6 and FIGS. 8-9, according to an embodiment of the present invention.

Referring now to FIG. 10, a generalized overview for a process 200 performing a wagering game is provided according to one embodiment.

In step 201, the wagering game is initiated and begins. As mentioned prior, this may be a result of a player committing a wager and beginning the wagering game. During this phase, the amount of the wager, the number of pay lines, the amount wagered per pay line, etc., may be specified.

In step 205, the base game of the wagering game is performed. In one embodiment, this may include the spinning of reels and performing a wagering game in accordance with the embodiments of FIGS. 3-4.

In step 210, a corresponding award is tabulated for a base game outcome, for example, in accordance with the symbol combination(s) specified in the pay table for the wagering game. As detailed prior, this may involve one or more randomly generated elements that correspond to one or more symbols and events of the wagering game base game. The award amount for the outcome is accumulated and stored such that any determined awards may be maintained for the duration of the wagering game. This may also include persistent digital storage to protect results in the case of power failures or other electro-mechanical errors that occur during the wagering game. Additionally, an award meter 84 may be integrated into a graphical user interface of the wagering game to reflect the current level or amount of winnings of the wagering game.

In step 215, a determination is made as to whether a bonus game is triggered from one or more events during the wagering game base game. One example of a triggering event includes the symbols shown in the base game outcome displayed in FIG. 4, but the invention is not limited to this particular example or set of symbols.

In step 220, in response to a bonus game being triggered, the bonus game is initiated. Initiation of the bonus game may include anticipatory audio and video sequences, additional random element generation, graphical interface generation, and input from the player to make choices or confirm initiation of the bonus game.

In step 225, the bonus feature(s) that will occur during the bonus game are determined. One embodiment of this is detailed in FIGS. 4-5, where icons are selected by the player until a predetermined combination is achieved. This process is further detailed in FIG. 11 for one embodiment. In one embodiment, the features include a determined number of free spins and a determined number of guaranteed wins. A player may or may not have a positive number of free spins or guaranteed wins. In the event that no free spins are available, the bonus game will progress to the guaranteed wins cash reels portion without performing any free spins.

In step 230, once the number of free spins and guaranteed wins are determined, a determination is made whether a free spin should be conducted, that is, whether the free spin counter displayed by the free spin meter 131 is zero.

In step 235, when the value of the free spin meter 131 is not zero, a free spin is conducted and a corresponding award is accumulated in accordance with the symbol combination of the free spin outcome and the pay table of the wagering game. The award may be shown distinctly and/or combined with a tabulating, accumulating award meter 84 as part of the wagering game interface.

In step 240, when the free spin is completed and awards are counted and attributed, the value of the number of free spins is decremented.

In step 245, a determination is made as to whether a line win occurred in the free spin outcome that has just completed. Another determination that may be made is whether an award greater than zero was determined for the free spin outcome. If not, flow returns to step 230 to continue processing of free spins if the value of the free-spin meter 131 indicates free spins remain.

In step 250, if the free spin outcome had a line win (or if the free spin outcome had a corresponding award greater than zero), the number of guaranteed wins indicated in the guaranteed-wins meter 132 is decremented. In this embodiment, each of the number of guaranteed wins guarantees a win (a non-zero award), so the guaranteed-wins meter 132 only changes in response to wagering game symbol outcomes that exhibit non-zero awards. In other embodiments, the guaranteed-wins meter 132 may increase in response to one or more (random) events that occur within the wagering game. After the number of guaranteed wins is decremented, flow returns to step 230 to continue processing free spins for as long as there are free spins to process.

In step 260, when the number of free spins is zero (i.e., there are no free spins to conduct and process), a determination is made as to whether any guaranteed wins should be conducted (i.e., if the number of guaranteed wins is zero or greater than zero). The number of guaranteed wins may be indicated by the guaranteed-wins meter 132 or another player perceivable mechanism.

In step 270, when the number of guaranteed wins is determined to be greater than zero, cash reels are spun in accordance with the number of remaining guaranteed wins. In one embodiment, this is illustrated by the prior description of FIGS. 8 and 9. That is, a number of cash reels are spun and the cash awards corresponding to the symbols displayed by the stopped cash reels are accumulated, optionally being reflected in a meter 84 of the wagering game player interface.

In step 280, the number of guaranteed wins is decremented by the number of cash reels that have been spun. Each cash reel provides a corresponding award as a guaranteed win, and so the number of guaranteed wins is reduced for each of the cash reels that have been used to grant a corresponding award. Once the number of guaranteed wins is adjusted in response to the spinning of one or more cash reels, flow returns to step 260 so that determination as to whether further guaranteed wins (and cash reel spins) are remaining for further awards.

In step 290, the wagering game bonus game concludes in response to the depletion of the number of free spins and the number of guaranteed wins.

In step 295, in response to any accumulated base game award and/or any bonus game award(s), the accumulated award is granted to the player.

In step 299, after any accumulated award is granted to the player, the wagering game is concluded. In one embodiment, the wagering game machine 10 returns to an attraction mode state, enticing the player to wager again.

Figure 11:
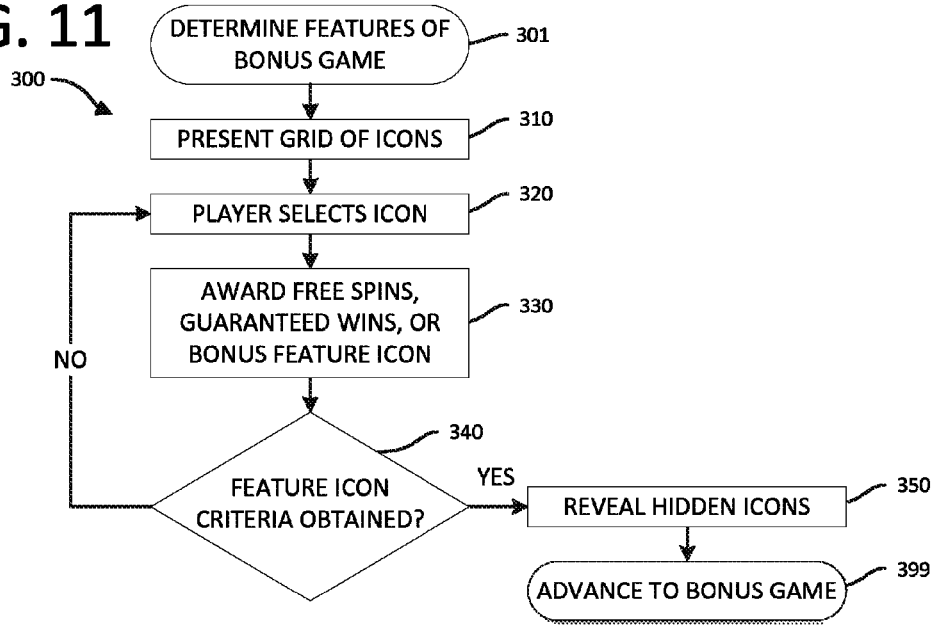
FIG. 11 is a flowchart for a process, corresponding to instructions executed by a controller, for determining features of a bonus game in accordance with FIG. 5-6, according to an embodiment of the present invention.

Referring now to FIG. 11, a generalized overview for a process 300 performing determination of features for a wagering game bonus game is provided according to an embodiment of the present invention. In one embodiment, process 300 occurs in response to step 225 using a player interface shown in FIGS. 5 and 6.

In step 301, process 300 begins to determine features for the bonus game of the wagering game.

In step 310, an array of icons is presented to the player on a user interface. In one embodiment, the array includes a primary-icon-selection zone 134 and a secondary-icon-selection zone 137 displayed in FIGS. 5 and 6. In other embodiments, other icon arrangements, zone configurations, methods of presentation and selection, etc., may be employed without departing from the spirit and scope of the invention.

In step 320, the player is prompted for input indicating selection of an icon from the array of icons. In one embodiment, the selection may be limited to one of the primary-icon-selection zone 134 and the secondary-icon-selection zone 137 dependent upon the alternating selection requirements detailed prior in regard to FIGS. 5-6.

In step 330, the selected icon indicates a number of free spins (incremented in the free-spins meter 131), a number of guaranteed wins (incremented in the guaranteed-wins meter 132), or one of one or more other graphical symbols used to control the operation of the selection phase.

In step 340, a determination is made as to whether a predetermined combination of feature icon(s) has been achieved as a result of the player selections. For example, the one or more other graphical symbols may include a "bag of money", a "poker chip", and a "die" as shown in FIG. 6. The combination of selected graphical symbols reflected in the tally zone 133 indicates whether picking will continue or conclude. For example, in FIG. 6, the selection of a third "die" icon in the secondary-icon-selection zone 137 (e.g., indicated by the check marks in the tally zone 133) provides a predetermined combination of icons by completing the corresponding row of check marks for the "die" icon. Completion of any row of check marks may indicate that the selection phase of the bonus game has ended. Any criterion for one or more feature icons may be employed to control the selection phase of the bonus game. In the event that a feature icon selection does not meet predetermined criteria, the process flow returns to step 315 to continue player icon selection.

In step 350, after a predetermined feature icon combination (or other criteria) is achieved, the remaining (unselected) icons, if any are presented, are revealed. One or more additional graphical and/or audio presentations may also occur.

In step 399, flow control returns to the (calling) bonus game process to conduct the remainder of the bonus game using the number of free spins, the number of guaranteed wins, selected feature icons, and any other information gathered during the selection process 300.

Figure 12:
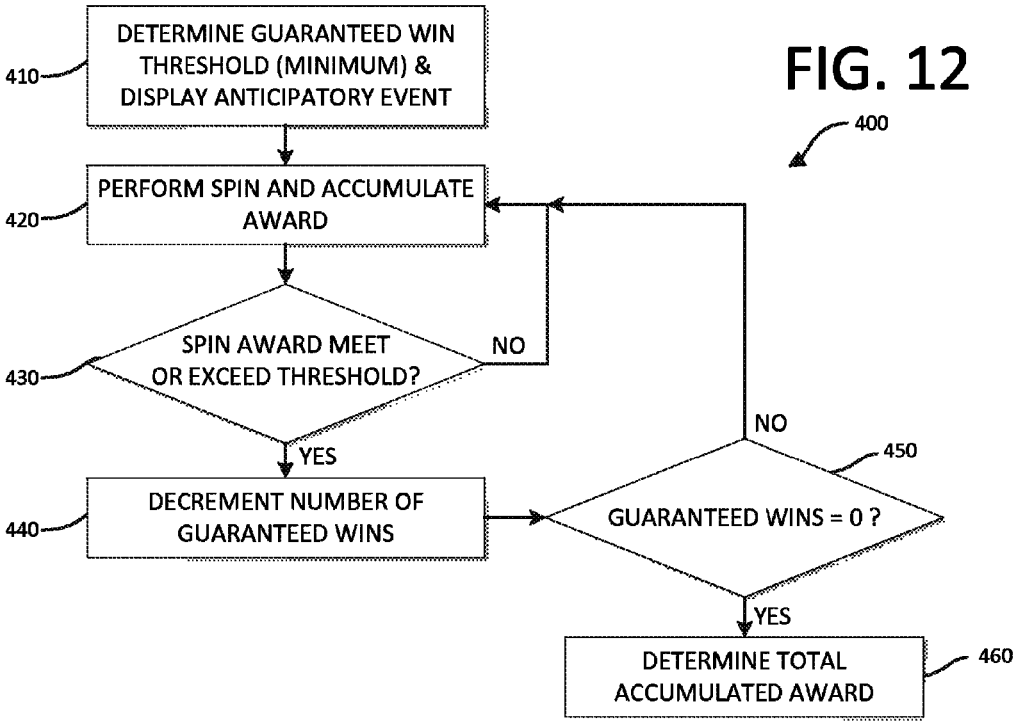
FIG. 12 is a flowchart for a process, corresponding to instructions executed by a controller, for determining a guaranteed win minimum threshold for one or more spins of a wagering game in accordance with FIG. 7, according to an embodiment of the present invention.

Referring now to FIG. 12, a generalized overview for a process 400 performing the determination and usage of a guaranteed win threshold for one or more spins of the wagering game according to one embodiment.

In step 410, a guaranteed-win threshold is established for one or more upcoming reel spins of the wagering game, and an anticipatory event is (optionally) displayed to the player to indicate the amount of the guaranteed-win threshold. One example of this event may include the graphical interface using notification 151 displayed in FIG. 7.

In step 420, a guaranteed-win spin is conducted (i.e., a spin having a minimum guaranteed winning threshold) as part of the wagering game. The guaranteed-win spin may be part of the base game or part of one or more bonus games. A corresponding award is associated with the conducted spin, for example, based on a combination of symbols in an array generated by a plurality of independent reels (as in the base game), or a cash spin reel reflecting an award based on the displayed icon (as in one of the bonus games). The corresponding award is accumulated in a running award total for all of the conducted guaranteed win spins. This may include the display of an accumulating award meter 84 on the graphical interface for the player.

In step 430, a determination is made as to whether the corresponding award for the conducted spin meets or exceeds the minimum guaranteed-win threshold established in step 410. Alternatively, the minimum guaranteed-win threshold may be determined after one or more spins occur, in response to a randomly determined event, or specified for a particular set of spins (e.g., the last spin of the round). If the corresponding award for the spin does not meet the minimum guaranteed-win threshold, process flow returns to step 420 so that another spin may be conducted.

In step 440, when the corresponding award for the spin meets or exceeds the minimum guaranteed-win threshold, the number of guaranteed wins is decremented.

In step 450, a determination is made as to whether the guaranteed-win spin count is zero (i.e., whether any guaranteed winning spins remain). If there are guaranteed wins remaining, process flow returns to step 420 to conduct another guaranteed-win spin.

In step 460, when the number of guaranteed-win spins reaches zero, a total accumulated award is determined for all of the conducted guaranteed-win spins.

Figure 13:
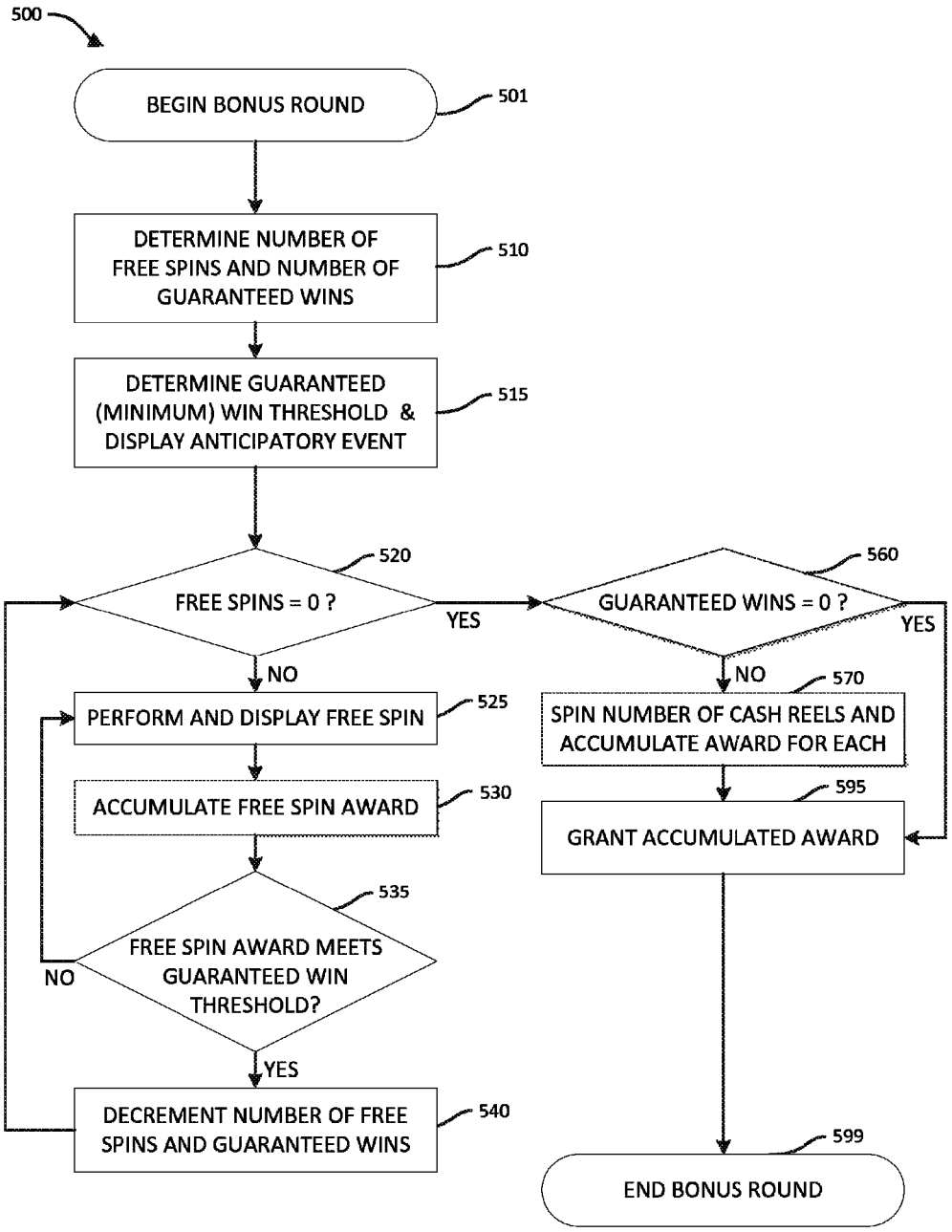
FIG. 13 is a flowchart for a generalized process, corresponding to instructions executed by a controller, for performing a bonus round for a wagering game using guaranteed wins that includes the screens of FIGS. 4-6 and FIGS. 8-9, according to an embodiment of the present invention.

Referring now to FIG. 13, a generalized overview for a process 500 performing a wagering game bonus round is provided according to one embodiment. The process 500 includes free spins having minimum threshold requirements for the symbol combinations generated by a plurality of reels for the free spins, followed by cash reel spins for any guaranteed wins remaining after the free spins are conducted.

In step 501, the bonus round begins. The bonus round may be initiated by one or more random elements of a wagering game base game, or directly initiated by input by a player. In this latter case, the bonus round may optionally execute as its own wagering-base game.

In step 510, a number of free spins and a number of guaranteed wins are determined for the bonus round. These values may be conducted and displayed to the player as detailed prior in regard to FIGS. 5-6. Alternatively, the number of free spins and guaranteed wins may be purely randomly determined without any input of selection by the player. Further, the number of free spins, the number of guaranteed wins, determination of either, and/or the decrementing of one or more these values or others need not be specifically displayed or required while remaining in the spirit and scope of the invention.

In step 515, a guaranteed-win (minimum) threshold is established for one or more upcoming reel spins of the wagering game, and an anticipatory event is (optionally) displayed to the player to indicate the amount of the guaranteed-win threshold. One example of this event may include the graphical interface using notification 151 displayed in FIG. 7.

In step 520, a determination is made is to whether the number of free spins is zero (i.e., whether any free spins have been granted or remain).

In step 525, when there are one or more free spins, a free spin is performed. This may include the display of the rotation of a plurality of reels to generate a free-spin outcome for the free spin. The presentation of the free spin may further include any associated anticipatory and operational graphical and audio presentations.

In step 530, a corresponding award is determined for the free spin. The corresponding award may be derived from the combination of symbols in an array of the free-spin outcome, the graphical icon displayed by a single reel (e.g., cash spin reel), etc. The corresponding award is accumulated in a running total counter for the bonus round, for example, an award meter 84.

In step 535, a determination is made as to whether the award for the free-spin outcome meets or exceeds the determined guaranteed-win threshold. If not, process flow control return to step 525 to conduct another free spin and accumulate a corresponding free spin award until a free spin award results that meets or exceeds the determined guaranteed-win threshold.

In step 540, when the free-spin outcome is determined to meet or exceed the determined guaranteed-win threshold, the number of free spins and the number of guaranteed wins are decremented. In the event that the number of guaranteed wins is already zero, the number of guaranteed wins will remain at zero. Process flow control then returns to step 520 to determine whether any free spins remain, and if so, the free spins will performed (step 525), awarded (step 530), and repeated (steps 525-535) until the determined guaranteed-win threshold is met or exceeded until the number of free spins is reduced to zero.

In step 560, after the number of free spins is zero, a determination is made as to whether the number of guaranteed wins is zero.

In step 570, a number of guaranteed-win cash reels are spun corresponding to the number of guaranteed wins remaining In the event that the number of guaranteed wins is higher than a maximum number of displayable cash reels, the process will continue until a number of cash reels equal to the remaining guaranteed wins are spun. A corresponding award is determined for each of the cash reels in accordance with the displayed symbol of each cash reel. The corresponding awards are accumulated, possibly reflected in a given award meter 84 of the player interface.

In step 595, after all the cash reels are spun and the corresponding awards are accumulated, the accumulated award is granted to the player, concluding the bonus round.

In step 599, the bonus round ends, potentially including associated graphical imagery and accompanying audio to reflect the granting of the accumulated award and results of the bonus round.

Figure 14:
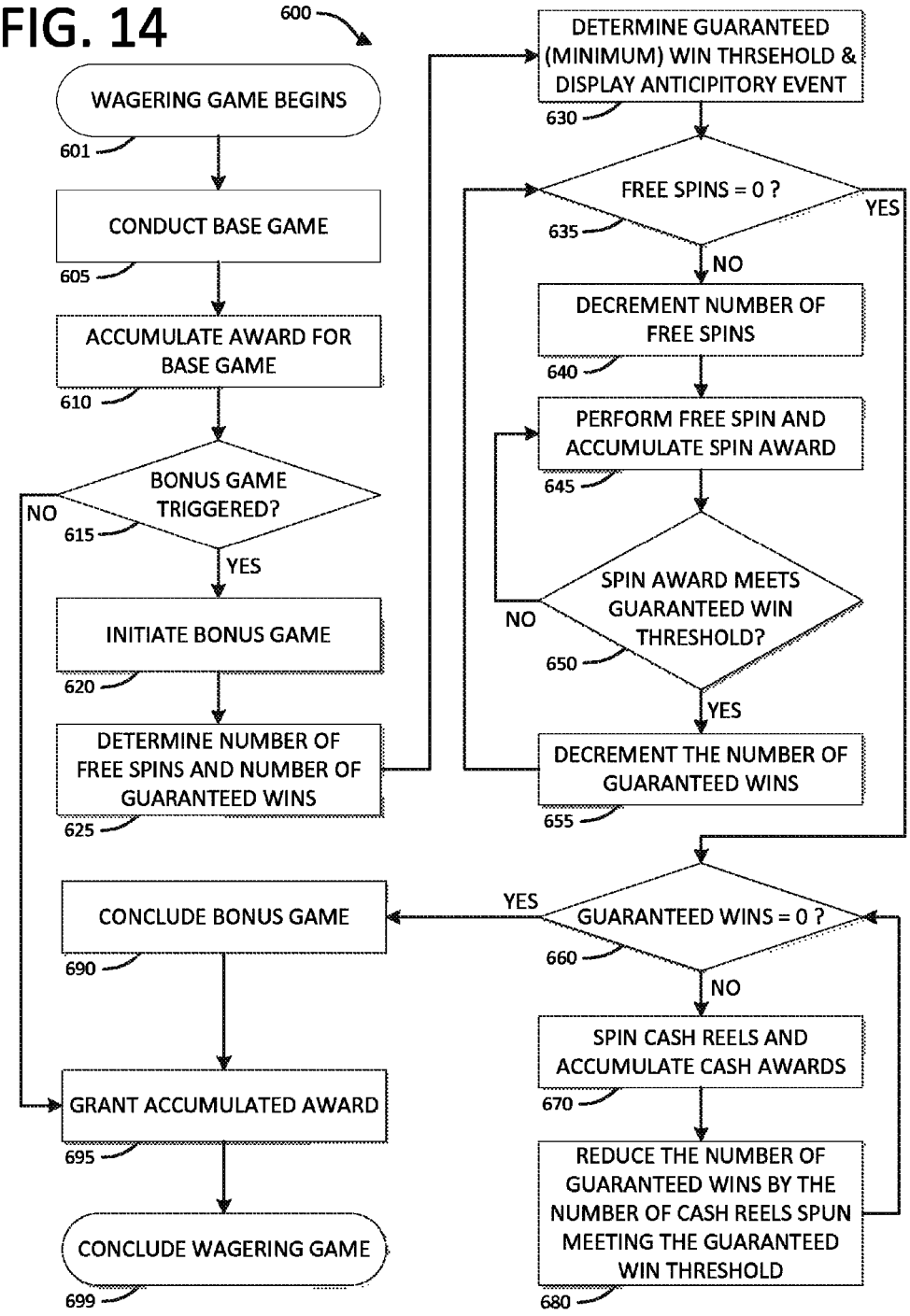
FIG. 14 is a flowchart for a generalized process, corresponding to instructions executed by a controller, for performing a wagering game using both guaranteed wins and a bonus round using guaranteed wins that includes the screens of FIGS. 4-9, according to an embodiment of the present invention.

Referring now to FIG. 14, a generalized overview for a process 600 performing a wagering game is provided according to one embodiment. The process 600 includes a base game, a bonus game having free spins having minimum guaranteed-win threshold requirements, and cash reel spins having minimum guaranteed-win threshold requirements.

In step 601, the wagering game begins. This may occur as a result of a player placing and committing a wager and initiating an instance of the wagering game.

In step 605, the base game of the wagering game is conducted.

In step 610, a corresponding award is determined for the base game outcome and the corresponding award is accumulated, possibly in one or more award meters 84 of the wagering game.

In step 615, a determination is made as to whether a bonus game has been triggered. The base game may have one or more bonus games that are triggered as a result of one or more random elements and/or one or more symbol results of the wagering-game outcome.

In step 620, when the bonus game is triggered, the bonus game is formally initiated. This may include graphical and audio presentations, player inputs, etc.

In step 625, a number of free spins and a number of guaranteed wins are determined for the bonus round. In one embodiment, this is conducted and displayed in regard to FIGS. 5-6. Alternatively, the number of free spins and guaranteed wins may be randomly determined without any input of selection by the player.

In step 630, a guaranteed-win (minimum) threshold is established for the bonus round. An anticipatory event is (optionally) displayed to the player to indicate the amount of the guaranteed-win threshold (e.g., notification 151).

In step 635, a determination is made is to whether the number of free spins is zero (i.e., whether any free spins have been granted or remain).

In step 640, the number of free spins is decremented immediately prior to the free spin being conducted.

In step 645, a free spin is conducted and a corresponding award is determined. The corresponding award may be displayed in a meter 84, and an accumulated-award meter 84 may also be present.

In step 650, a determination is made as to whether the corresponding award for the free spin outcome meets the determined guaranteed-win threshold. If not, process flow control return to step 645 to conduct another free spin, accumulate corresponding award, etc.

In step 655, when the free-spin outcome is determined to meet the determined guaranteed-win threshold, the number of guaranteed wins is decremented. In the event that the number of guaranteed wins is already zero, the number of guaranteed wins will remain at zero. Process flow control then returns to step 635 to determine whether any free spins remain to be conducted.

In step 660, after the number of free spins is determined to be zero, a determination is made as to whether the number of guaranteed wins is zero.

In step 670, a number of guaranteed-win cash reels are spun corresponding to the number of guaranteed wins remaining, up to a maximum number of cash reels that are visually displayed on the graphical player interface.

In step 680, the number of guaranteed wins is reduced by the number of spun cash reels that have a corresponding award that meets (or exceeds) the predetermined minimum guaranteed-win threshold. Process flow control returns to step 660 to determine whether more cash reels are required to provide any additional guaranteed-win awards.

In step 690, the bonus round ends, potentially including associated graphical imagery and accompanying audio to reflect the granting of the accumulated award and results of the bonus round. Additional graphical presentation may occur to reflect the base-game outcome, in addition to any results derived from the bonus round.

In step 695, the accumulated award is granted to the player. This may include the awards garnered during the base game, the one or more bonus rounds, and any additional events that have taken place in the wagering game as a whole.

In step 699, the wagering game concludes. Graphical presentations may occur to reflect the events of the wagering game and/or entice the player to wager again.

In one embodiment, a player triggers a bonus round as a result of a wagering-game base-game outcome. The player is presented with a first and second set of hidden icons 134, 137 wherein single icons from each set are alternately chosen and revealed to accrue a number of free spins, a number of guaranteed wins, and iconic entries displayed in a matrix to determine an overall bonus level for the bonus game. The first and/or second set of icons may additionally include prizes that are immediately granted, rather than being deferred to other outcomes and/or the spinning of future reels. Icons from the first set of icons reveal one of free spins and guaranteed wins, but may alternatively award both. In response to an icon being selected from the first set of icons, a corresponding amount of spins revealed will increment the appropriate meter. Icons from the second set of icons reveal one or more entries of the matrix to determine the bonus level for the bonus game. In response to an icon being selected from the second set of icons, an icon is added to the relevant three position trail, wherein each trail represents the three different levels of the bonus game that may include feature(s) or details of the bonus-game mechanics. That is, completing a set of three of the same icons in the matrix will result in starting the bonus round with the amount of free spins and guaranteed wins accumulated in the meters, in addition to a bonus level that may include one or more special gaming features. One example includes the provision for WILD symbols during the spinning reels that are fixed within the outcome symbol array, WILD symbols that migrate within the outcome symbol array with every spin, randomly designated WILD array elements, WILD symbols locking into place in the symbol array for the remainder of the free spins, etc.

When one row of the icon matrix is completed, the player is awarded the corresponding bonus level, prize, or upcoming feature, along with the total number of accumulated free spins and guaranteed wins. It is possible to gain a combination of free spins and guaranteed wins, or one or the other exclusively. That is, the number of accumulated free spins or the number of guaranteed wins may be zero. The bonus level may provide additional free spins, guaranteed wins, or additional benefits or awards, like award multipliers, additional bonus game(s) initiation, or use of specific reels for generating outcomes.

After the bonus level is determined, the free spins are conducted. As each free spin completes, the number of free spins reduces by one. If the free spin has an outcome having one or more winning combinations (i.e., one or more pay line wins), the number of guaranteed wins is also reduced by one. If the outcome has no winning combinations on any of the pay lines for the free spins, the number of guaranteed wins does not reduce.

The free spins may or may not have a guaranteed-win minimum-credit award associated with the free spins that causes the free spin to be conducted again in response to the free-spin outcome not meeting the minimum award. In response to a guaranteed-win minimum-credit award being specified, the player may receive a number of free spins where the number of spins remaining only decrements when the win is over a specific threshold. For example, the number of free spins remaining does not decrement unless the award is over the total bet used in the triggering condition; when an award is less than that amount, the remaining number of free spins remains at its current amount. The threshold amount may also be a variable option determined prior to the start of the free spins. One example includes an anticipatory event playing out determining the threshold amount, and at the end of the event the threshold amount may be designated as an integer multiple of the bet level (e.g., double or triple the initial wager amount).

After the free spins are conducted, any remaining or specified guaranteed wins are conducted. In the event that the player accrues only a number of guaranteed wins and no free spins, the bonus event skips the free spin stage and performs the guaranteed-win reel-spin stage. The guaranteed wins may be conducted as additional free spins having a guaranteed-win minimum-credit award (e.g., randomly determined as a specific multiple of the wager amount), or as guaranteed cash awards determined by spinning award reels specifying a particular award amount (with or without a specific guaranteed-win minimum requirement). For example, a set of active cash reels spin and any award value that appears on an active reel is awarded.

If the number of guaranteed wins is zero, the bonus game simply ends. The number of reels specifying guaranteed cash awards may use a number of reels that is less than the required corresponding total number of guaranteed wins. For example, when more than five guaranteed wins are available for a set of five cash-guaranteed-win reels, the amounts shown on the first five reels are accrued and the reels would spin again until all the remaining guaranteed wins have been awarded. Once the winnings for the free spins and/or guaranteed-win spins are determined, the total for the winnings are paid together as a final win for the bonus game.

While FIGS. 10-14, described by way of example above, represent various algorithms that correspond to at least some instructions stored and executed by the game-logic circuitry 40 in FIG. 2 to perform the above described functions associated with the disclosed concepts.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system primarily dedicated to playing at least one regulated casino wagering game having a base game and a bonus game, the gaming system comprising:

an electronic display device;

one or more electronic input devices configured to detect a physical item associated with a monetary value that establishes a credit balance on the gaming system;

a random element generator configured to generate one or more random elements; and game-logic circuitry configured to:

in response to an input indicative of a wager drawn on the credit balance, initiate the base game;

determine an outcome of the base game based, at least in part, on the one or more random elements;

grant an award in response to the outcome of the base game meeting a predetermined award criterion;

in response to a triggering event; conduct the bonus game by directing the electronic display device to display indicia;

in response to receiving data signals from at least one of the one or more electronic input devices indicative of indicia selections, award at least one of a free spin, a guaranteed win, or both, until a predetermined condition is met, wherein a positive number of guaranteed wins are accrued;

direct the electronic display device to display a plurality of symbol-bearing reels for the bonus game;

after the predetermined condition is met and while a number of the accrued free spins is greater than zero, (i) spin and stop the plurality of symbol-bearing reels to display a symbol combination representing a free spin outcome based, at least in part, on the one or more random elements;

(ii) in response to the displayed symbol combination being a non-losing outcome corresponding to a minimum award threshold, decrement the number of accrued guaranteed wins and grant an award corresponding to the displayed non-losing outcome;

(iii) decrement the number of the accrued free spins; and (iv) repeat (i)-(iv) until the number of accrued free spins equals zero; and in response to any accrued guaranteed wins remaining after completing all the accrued free spins, display the spinning and stopping of at least one cash-spin reel for each of the remaining accrued guaranteed wins, the spinning and stopping being based, at least in part, on the one or more random elements, the at least one cash-spin reel being populated with one or more cash symbol specifying a monetary award amount, and in response to stopping the at least one cash-spin reel, (i) decrement the number of accrued guaranteed wins; and (ii) grant an award corresponding to at least one of the displayed cash symbols.

2. The gaming system of claim 1, wherein prior to decrementing the number of accrued guaranteed wins, in response to the displayed symbol combination not meeting the minimum award threshold, the game-logic circuitry is further configured to:

re-spin and stop the plurality of symbol-bearing reels to display symbol combinations representing an additional free spin outcome based, at least in part, on the one or more random elements; and grant a corresponding award for each additional free spin outcome until the corresponding displayed symbol combination meets the minimum award threshold.

3. The gaming system of claim 1, wherein in response to the at least one of the displayed cash symbol specifying a monetary award amount not meeting a predetermined guaranteed minimum award, re-spin and stop the at least one cash-spin reel at an additional cash symbol and determine an additional award corresponding to the additional cash symbol until the additional award meets or exceeds the predetermined guaranteed minimum award.

4. The gaming system of claim 1, wherein the minimum award threshold is larger than zero and the displayed symbol combination is determined to be a non-losing outcome when the award corresponding to the displayed non-losing outcome meets or exceeds the minimum award threshold.

5. The gaming system of claim 4, wherein the game-logic circuitry is further configured to determine the minimum award threshold based, at least in part, on the one or more random elements.

6. The gaming system of claim 5, wherein the minimum award threshold is a positive integer multiple of the wager.

7. The gaming system of claim 1, wherein the at least one cash-spin reels are simultaneously displayed on the electronic display device, each cash-spin reel spinning and stopping independently.

8. A gaming system primarily dedicated to playing at least one regulated casino wagering game having a base game and a bonus game; the gaming system comprising:

an electronic display device;

one or more electronic input devices configured to detect a physical item associated with a monetary value that establishes a credit balance on the gaming system;

a random element generator configured to generate one or more random elements; and game-logic circuitry configured to:

initiate the base game in response to an input indicative of a wager drawn on the credit balance;

determine an outcome of the base game based, at least in part, on the one or more random elements;

grant an award in response to the outcome of the base game meeting a predetermined award criterion;

in response to a triggering event, provide the player a first number of free spins and a second number of guaranteed-win plays;

for each of the first number of free spins, rotate a first plurality of symbol-containing reels to a random stop position, the random stop position being determined, at least in part, by the one or more random elements, pay any awards associated with the random stop position, and in response to paying any award associated with the random stop position, decrement the number of guaranteed-win plays; and in response to at least one guaranteed-win play remaining at the conclusion of the first number of free spins, display the spinning and stopping of at least one cash-spin reel for each of the remaining accrued guaranteed wins, the spinning and stopping being based, at least in part, on the one or more random elements, the at least one cash-spin reel being populated with one or more cash symbols specifying a monetary award amount, and provide a guaranteed award associated with each cash-spin reel spin.

9. The gaining system of claim 8, wherein the free spins and the guaranteed-win plays are provided based on player selections in a first portion of the bonus game.

10. The gaming system of claim 8, wherein the free spins and guaranteed-win plays are provided based on the triggering event.

11. The gaming system of claim 8; wherein the free spins or guaranteed-win plays are provided based on the base game.

12. The gaming system of claim 8, wherein an individual guaranteed-win play has a higher expected value than an individual free spin.

13. The gaming system of claim 12, wherein each guaranteed-win play includes rotating a second plurality of symbol-containing reels, the second plurality of symbol-containing reels providing a higher expected value than the first plurality of symbol-containing reels.

14. The gaming system of claim 13, wherein the second plurality of symbol-containing reels comprise the at least one cash-spin reel.

15. A method of operating a gaming system primarily dedicated to playing at least one regulated casino wagering game having a base game and a bonus game, the gaming system including a random element generator, game-logic circuitry, and a casino gaming machine, the casino gaming machine including a secure gaming cabinet, an electronic display device, and one or more electronic input device, the gaming cabinet constructed to house components associated with the casino wagering game, the electronic display device and the one or more electronic input device being coupled to the gaming cabinet; the method comprising:

generating one or more random elements with the random element generator;

detecting, via one of the one or more electronic input devices, a physical item associated with a monetary value that establishes a credit balance on the gaming system;

receiving a wager input indicative of a wager drawn on the credit balance to initiate the casino wagering game;

determining; by the game-logic circuitry; an outcome of the base game based, at least n part, on the one or more random elements;

granting, by the game-logic circuitry, an award in response to the outcome of the base game meeting a predetermined award criterion;

in response to a triggering event, providing, by the game-logic circuitry, the player a first number of free spins and a second number of guaranteed-win plays;

for each of the first number of free spins, rotating, by the game-logic circuitry, a first plurality of symbol-containing reels to a random stop position, the random stop position being determined, at least in part, by the one or more random elements, paying any awards associated with the random stop position, and in response to paying any award associated with the random stop position, decrementing, by the game-logic circuitry, the number of guaranteed-win plays; and in response to at least one guaranteed-win play remaining at the conclusion of the first number of free spins, displaying, on the electronic display device, the spinning and stopping of at least one cash-spin reel for each of the remaining accrued guaranteed wins, the spinning and stopping being based, at least in part, on the one or more random elements, the at least one cash-spin reel being populated with one or more cash symbols specifying a monetary award amount, and providing a guaranteed award associated with each cash-spin reel spin.

16. The method of claim 15, wherein the free spins and the guaranteed-win plays are provided, by the game-logic circuitry, based on player selections in a first portion of the bonus game.

17. The method of claim 15, wherein the free spins or guaranteed-win plays are provided, by the game-logic circuitry, based on the base game.

18. The method of claim 15, wherein an individual guaranteed-win play has a higher expected value than an individual free spin.

19. The method of claim 18, wherein each guaranteed-win play includes rotating; by the game-logic circuitry; a second plurality of symbol-containing reels, the second plurality of symbol-containing reels providing a higher expected value than the first plurality of symbol-containing reels.

20. The method of claim 19, wherein the second plurality of symbol-containing reels includes the at least one cash-spin reel.

* * * * *